US010622730B2

(12) United States Patent
Wu et al.

(10) Patent No.: US 10,622,730 B2
(45) **Date of Patent: *Apr. 14, 2020**

(54) METAL LEAF SPRING STRUCTURE OF ELECTRICAL CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chang Han Lee, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/987,200

(22) Filed: May 23, 2018

(65) Prior Publication Data

US 2018/0342817 A1 Nov. 29, 2018

(30) Foreign Application Priority Data

May 26, 2017 (TW) ..... 106207567 U

(51) Int. Cl.
*H01R 4/48* (2006.01)
*H01R 12/51* (2011.01)

(52) U.S. Cl.
CPC ..... *H01R 4/4818* (2013.01); *H01R 4/4827* (2013.01); *H01R 4/4845* (2013.01); *H01R 12/515* (2013.01)

(58) Field of Classification Search
CPC .... H01R 4/4827; H01R 4/4818; H01R 11/09; H01R 12/515; H01R 12/57; H01R 12/716; H01R 13/113; H01R 13/62; H01R 2201/20; H01R 31/085; H01R 4/4836; H01R 4/4845; H01R 9/2416; H01R 9/2616; H01R 4/483; H01R 4/4854; H01R 9/26; H01R 4/48; H01R 4/4809; H01R 9/24; H01R 9/2408; H01R 9/2491; H01R 9/2675

See application file for complete search history.

(56) References Cited

U.S. PATENT DOCUMENTS 4,637,677 A * 1/1987 Barkus ..... H01R 4/52 439/724
6,062,918 A * 5/2000 Myer ..... H01R 13/187 439/833

(Continued)

*Primary Examiner* — Edwin A. Leon
*Assistant Examiner* — Matthew T Dzierzynski
(74) *Attorney, Agent, or Firm* — Rosenberg, Klein & Lee

(57) ABSTRACT

A metal leaf spring structure of electrical connection terminal includes a main body. The main body has a base section defined with a first end and a second end. The first end is connected with a first section and a locating section. The second end is connected with a bight section and a reciprocally movable second section. The locating section is positioned in the reciprocally moving path of the second section to setup a moving endpoint of the second section. The metal leaf spring structure of electrical connection terminal improves the shortcomings of the conventional metal leaf spring that the conductive wire cannot be plugged into the terminal by a precise angle so that the metal leaf spring is over-bent to affect the pressing and securing effect.

36 Claims, 5 Drawing Sheets

(56) References Cited

U.S. PATENT DOCUMENTS

| | | | | |
|---|---|---|---|---|
| 6,773,313 | B2 * | 8/2004 | Pedrinelli | H01R 4/4845<br>439/828 |
| 6,911,602 | B2 * | 6/2005 | Conrad | H01R 9/2608<br>174/68.2 |
| 7,249,963 | B2 * | 7/2007 | Ramm | H01R 4/489<br>439/437 |
| 7,329,143 | B2 * | 2/2008 | Schrader | H01R 4/4827<br>439/441 |
| 7,607,956 | B2 * | 10/2009 | Lang | H01R 4/4827<br>439/728 |
| 8,292,677 | B2 * | 10/2012 | Gassauer | H01R 13/15<br>439/729 |
| 8,388,387 | B2 * | 3/2013 | Koellmann | H01R 4/4845<br>439/729 |
| 8,579,651 | B2 * | 11/2013 | Hanning | H01R 4/4836<br>439/441 |
| 9,525,218 | B2 * | 12/2016 | Wu | H01R 4/4818 |
| 10,193,244 | B2 * | 1/2019 | Aboulkassem | H01R 4/4836 |

* cited by examiner

METAL LEAF SPRING STRUCTURE OF ELECTRICAL CONNECTION TERMINAL

BACKGROUND OF THE INVENTION

1. Field of the Invention

The present invention relates generally to a metal leaf spring structure of electrical connection terminal, and more particularly to an assembly of a terminal device for an electro-conductive wire to plug in and connect therewith and a metal leaf spring for pressing or releasing the electro-conductive wire.

2. Description of the Related Art

A conventional terminal device or wire pressing terminal has an insulation case (generally made of plastic material) and an electrical connector or metal member (or metal leaf spring). The metal leaf spring is enclosed in the insulation case to press and electrically connect with or release a conductive wire plugged into the terminal device.

Such electrical connection terminal devices include two types. The first type of electrical connection terminal device is inserted on a circuit board such as printed circuit board (PCB). The second type of electrical connection terminal device is latched with a grounding rail (or conductive rail) in a row to set up a common grounding device of an electrical apparatus or mechanical equipment.

The aforesaid electrical connection terminal is inserted on a circuit board such as printed circuit board (PCB) or a grounding rail and includes an insulation case having a perforation or a wire plug-in hole for the conductive wire to plug into the interior of the case. The case defines a chamber in which the electrical connector (or the metal leaf spring) is mounted. The metal leaf spring serves to contact or electrically connect with the conductive wire plugged into the case. The electrical connector has an elastic free end. After the conductive wire is plugged into the case, the free end of the electrical connector will bite the conductive wire to prevent the conductive wire from easily detaching from the electrical connector out of contact with the electrical connector. Unless an operator uses a tool to extend into the case and push/press the free end, the conductive wire cannot be released from the contact of the electrical connector.

The metal leaf spring of the conventional electrical connection terminal device has some shortcomings in structural design and application. For example, when plugging the conductive wire into the terminal device, due to human operation factor, it often takes place that the conductive wire cannot enter the terminal device by a precise angle to push/press the free end of the metal leaf spring. In this case, the elastic free end of the metal leaf spring can hardly securely press and restrict the conductive wire or the metal leaf spring will be over-bent. Especially, after a long period of high-frequency assembling operation of the conductive wire, elastic fatigue is apt to happen to the structure of the metal leaf spring.

As a result, the lifetime of the terminal device will be shortened.

In order to improve the shortcoming of the metal leaf spring that elastic fatigue is apt to happen to the structure of the metal leaf spring to shorten the lifetime of the terminal device, a technical means for preventing the metal leaf spring from being over-bent has been disclosed.

The conventional clamping spring (or metal leaf spring) is assembled with a reception member (or frame body). A protrusion section is formed on one side of the reception member in the moving path of the clamping leg (or free end) of the clamping spring to prevent the clamping leg from being over-biased.

However, as well known by those who are skilled in this field, the structure of the additional protrusion section of the reception member (or frame body) in cooperation with the clamping spring (or metal leaf spring) is relatively complicated. In addition, when the conductive wire is plugged into the electrical connection terminal by an imprecise angle, the conductive wire also will push/press the clamping leg of the clamping spring to deflect the clamping leg and make the clamping leg pass over the protrusion section. This deteriorates the effect that the protrusion section prevents the clamping leg from being over-biased. This is not what we expect.

To speak representatively, the above references reveal some shortcomings existing in the conventional electrical connection terminal and the metal leaf spring in design of relevant assembling structure. In case the assembling structure of the terminal device and the metal leaf spring is redesigned to be different from the conventional electrical connection terminal, the use form of the electrical connection terminal can be changed to practically improve the application of the electrical connection terminal and enhance the operation stability of the electrical connection terminal.

It is found that the structural form of an optimal terminal device or metal leaf spring must overcome or improve the aforesaid shortcomings of the conventional electrical connection terminal and include several design considerations as follows:

1. The structural form of the conventional electrical connection terminal that the reception member (or frame body) is additionally formed with the protrusion section must be omitted so as to improve the shortcomings existing in the conventional electrical connection terminal that the cooperative structure is relatively complicated (and/or the manufacturing cost is relatively high) and the clamping leg (or the free end of the metal leaf spring) is apt to deflect and pass over the protrusion section to deteriorate the effect that the protrusion section prevents the clamping leg from being over-biased.
2. In the condition that the metal leaf spring can keep stably pressing and restricting the conductive wire, a true moving range of the metal leaf spring (or the free end thereof) is set up. Especially, the metal leaf spring itself forms an end position, whereby the free end can only move to reach the set end position, that is, the metal leaf spring itself can stop the free end. Therefore, no matter how the free end moves, the free end cannot pass over the metal leaf spring so that the free end is prevented from being over-biased. In this case, the possibility that the metal leaf spring is over-bent to shorten the lifetime of the electrical connection terminal as in the conventional structure is minimized.

SUMMARY OF THE INVENTION

It is therefore a primary object of the present invention to provide a metal leaf spring structure of electrical connection terminal. The metal leaf spring structure includes a main body. The main body has a base section defined with a first end and a second end. The first end is connected with a first section and a locating section. The second end is connected with a bight section and a reciprocally movable second section. The locating section is positioned in the reciprocally moving path of the second section to set up a moving end point of the second section. The metal leaf spring structure of electrical connection terminal improves the shortcomings of the conventional metal leaf spring that the conductive wire cannot be plugged into the terminal by a precise angle so that the metal leaf spring is over-bent to affect the pressing and securing effect.

In the above metal leaf spring structure of electrical connection terminal, a bent section is formed between the first end of the base section and the first section. The bent section contains an angle. The first section is bent toward the second end of the base section and obliquely extends to connect with the locating section, whereby a subsidiary bent section is formed between the first section and the locating section. The subsidiary bent section contains an angle. The bight section between the second end and the second section of the base section contains an angle, whereby the second section obliquely extends in a direction to the first end of the base section. When the second section is moved forward to contact or push/press the locating section, the subsidiary bent section enables the locating section to provide an elastic action force for helping the second section to move backward toward the initial position. Accordingly, the second section is prevented from being over-biased.

In the above metal leaf spring structure of electrical connection terminal, a protrusion section is formed on the locating section. The (insulation) case or the electrical connection member is formed with a recess. The protrusion section can be fixed in the recess to help in fixing the locating section.

The present invention can be best understood through the following description and accompanying drawings, wherein:

DETAILED DESCRIPTION OF THE PREFERRED EMBODIMENTS

Figure 2:
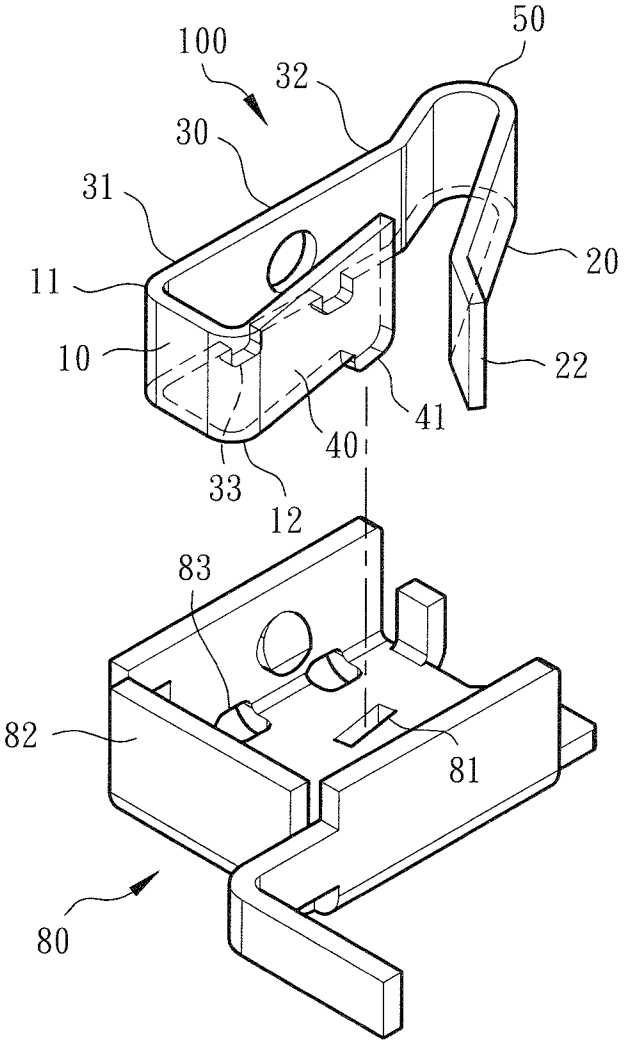
FIG. 2 is a perspective exploded view according to FIG. 1.
Figure 1:
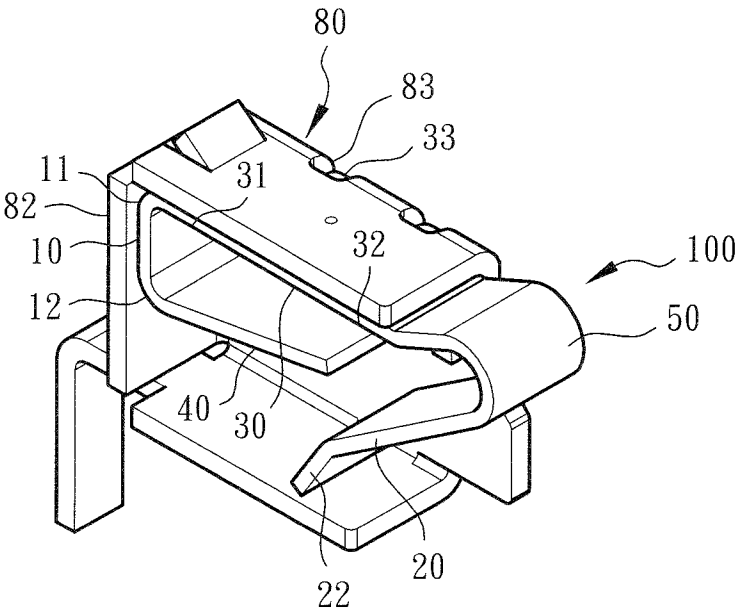
FIG. 1 is a perspective assembled view of the present invention and the electrical connection member, showing that the electrical connection member is formed as a frame body.
Figure 3:
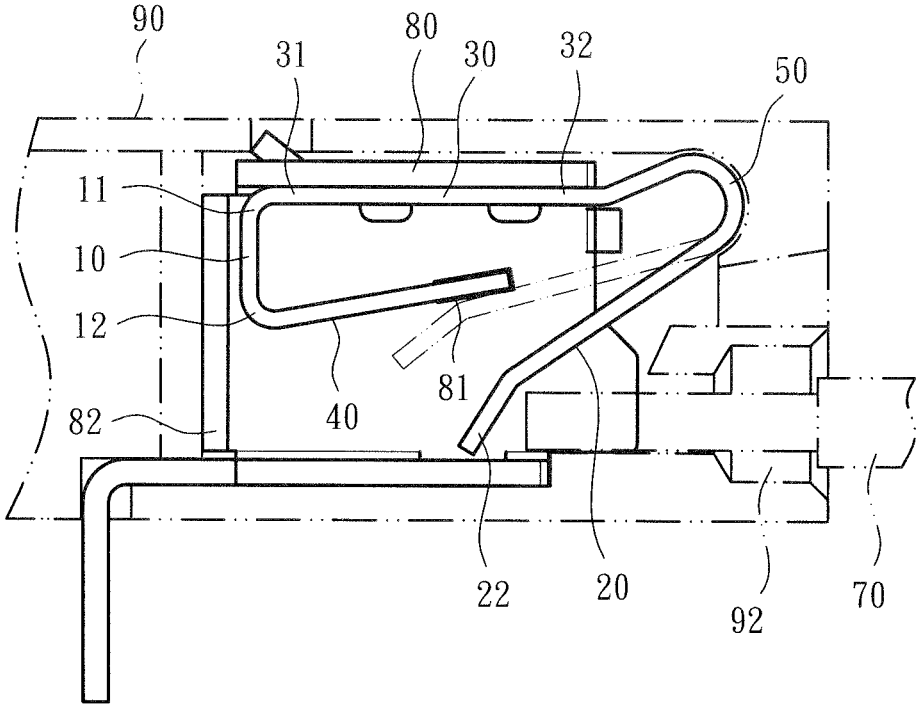
FIG. 3 is a view showing the operation of the metal leaf spring of FIG. 1, in which the phantom lines show that the conductive wire is plugged into the case to bias the second section of the main body.

Please refer to FIGS. 1, 2 and 3. The metal leaf spring structure of electrical connection terminal of the present invention includes a main body 100. The main body 100 is selectively made of elastic metal sheet or the like material by means of pressing in the form of a plate body. The main body 100 is mounted on a case 90 made of insulation material. Alternatively, the main body 100 is assembled with an electrical connection member 80 and the main body 100 and the electrical connection member 80 are together assembled and mounted on the case 90.

As shown in the drawings, the main body 100 includes a base section 30 defined with a first end 31 and a second end 32. The first end 31 is connected with a first section 10 and a locating section 40. The second end 32 is connected with a bight section 50 and a reciprocally movable second section 20. The locating section 40 is positioned in a reciprocally moving path of the second section 20 to set up a moving end point or moving range of the second section 20.

To speak more specifically, a bent section 11 is formed between the first end 31 of the base section and the first section 10. The bent section 11 contains an angle, which is an acute angle, a right angle or an obtuse angle. In addition, the first section 31 is bent toward the second end 32 of the base section and extends to connect with the locating section 40, whereby a subsidiary bent section 12 is formed between the first section 10 and the locating section 40. The subsidiary bent section 12 contains an angle, which is an acute angle, a right angle or an obtuse angle.

As shown in FIG. 3, the locating section 40 obliquely extends in a direction to the upper side of the drawing, whereby the angle contained between the first section 10 and the locating section 40 (or the subsidiary bent section 12) is an acute angle. The second section 20 obliquely extends in a direction to the lower side of the drawing, whereby the angle contained between the second section 20 and the base section 30 is an acute angle.

As shown in FIGS. 1, 2 and 3, the bight section 50 between the second end 32 and the second section 20 of the base section contains an angle, whereby the second section 20 extends in a direction to the first end 31 of the base section. At this time, it is defined that the second section 20 is positioned in an initial position. When the second section 20 is moved forward to contact or push/press the locating section 40, the subsidiary bent section 12 enables the locating section 40 to provide an elastic action force for helping the second section 20 to move backward toward the initial position. Accordingly, the second section 20 is prevented from being over-biased.

In a preferred embodiment, a protrusion section 41 is formed on an edge or a lateral side of the locating section 40. The (insulation) case 90 or the electrical connection member 80 is formed with a recess. The protrusion section 41 can be fixed in the recess to help in fixing the locating section 40.

In this embodiment, the electrical connection member 80 is formed as a frame body for receiving the main body 100. In addition, the electrical connection member 80 is formed with a recess 81 in which the protrusion section 41 of the locating section 40 is securely assembled.

As shown in FIGS. 1 and 2, the lateral side of the base section 30 is formed with finger sections 33 and the electrical connection member 80 is formed with mouth sections 83. The finger sections 33 can be inserted in the mouth sections 83 to securely assemble the main body 100 with the electrical connection member 80 with the second section 20 freely reciprocally movable.

As shown in FIG. 3, the case 90 has a wire plug-in hole 92. The conductive wire 70 can be plugged through the wire plug-in hole 92 into the case 90 to be pressed and restricted by the main body 100 and electrically connected with the electrical connection member 80.

To speak more specifically, when an operator plugs the conductive wire 70 through the wire plug-in hole 92 into the case 90 to electrically connect with the electrical connection member 80, the conductive wire 70 pushes the second section 20 to move in a direction to the locating section 40. Also, in cooperation with the structure of the bight section 50, the second section 20 or the tail end 22 of the second section 20 swings toward the lower side of the drawing to securely press and restrict the conductive wire 70 entering the case 90 or the electrical connection member 80.

It should be noted that the locating section 40 of the main body 100 serves as a moving end point structure of the second section 20. This ensures that when the second section 20 is pushed/pressed and biased by the conductive wire 70, the second section 20 is prevented from being over-biased as the clamping leg of the conventional terminal that passes over the stop point (or the protrusion section). In addition, the locating section 40 has the form of an (entirely) plane structure, whereby the second section 20 can snugly attach to the locating section 40 without deflecting.

Figure 4:
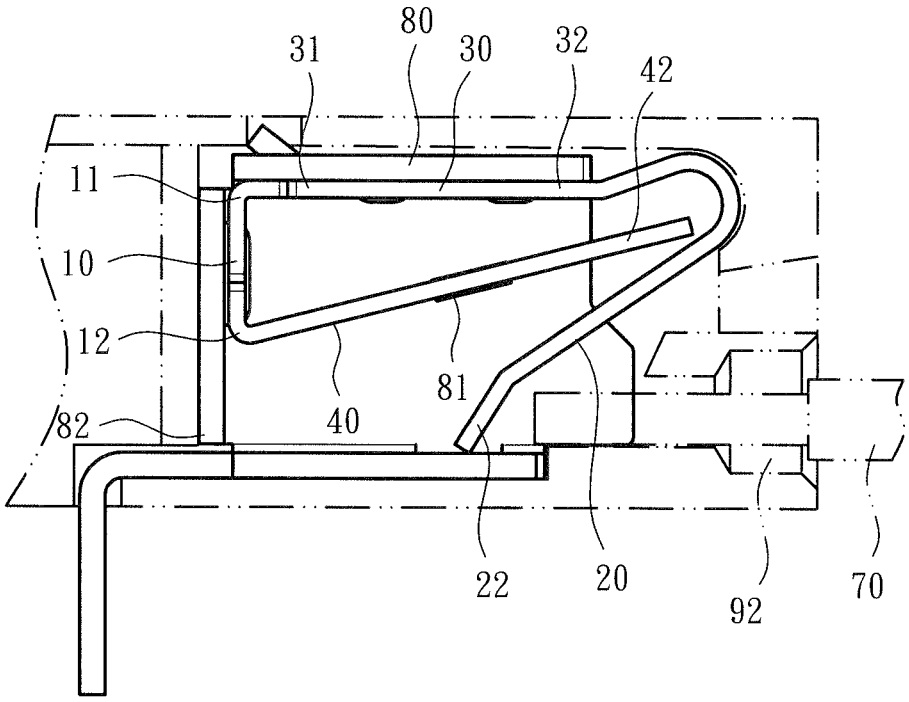
FIG. 4 is a view of a preferred embodiment of the present invention, showing the structure of the locating section extending to a position close to the bight section.

Please now refer to FIG. 4, which shows a modified embodiment of the main body 100 of the present invention. In this embodiment, the locating section 40 of the main body has a tail section 42 extending to a position close to the bight section 50. Therefore, when the conductive wire 70 pushes the second section 20 to move toward the locating section 40, in case the second section 20 reaches or contacts the tail section 42, the tail section 42 can prevent the second section 20 from being over-biased. Also, with the position where the protrusion section 41 is assembled with the recess 81 serving as a fulcrum, the tail section 42 will provide an elastic action force to help the bight section 50 to increase the pressing force of the second section 20 against the conductive wire 70.

FIG. 4 also shows a preferred embodiment in which the first section 10 is attached to the sidewall 82 of the electrical connection member 80, whereby the electrical connection member 80 provides a support effect for the main body 100 so that the main body 100 and the electrical connection member 80 can be more securely assembled with each other.

Figure 5:
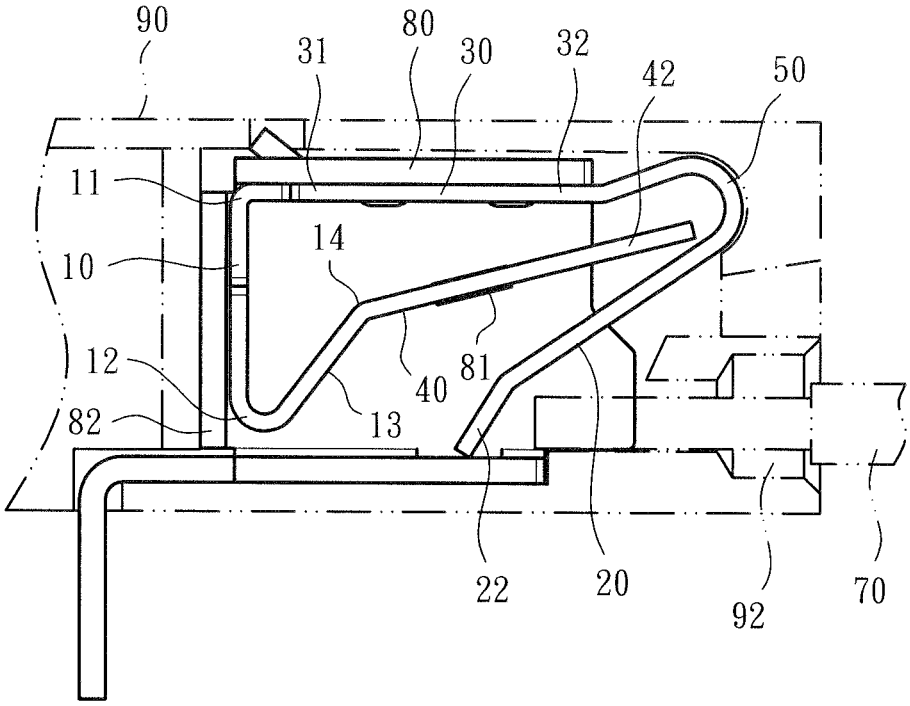
FIG. 5 is a view of a modified embodiment of the present invention, showing the structure of the subsidiary bent section between the first section and the locating section.

Please now refer to FIG. 5, which shows a modified embodiment of the main body 100 of the present invention. In this embodiment, a connection section 13 is disposed between the subsidiary bent section 12 and the locating section 40.

To speak more specifically, the connection section 13 obliquely extends in a direction to the base section 30 and the second end 32 to form a reverse bent section 14 connected with the locating section 40. As shown in the drawing, the angle contained between the first section 10 and the connection section 13 (or the subsidiary bent section 12) is an acute angle smaller than the obtuse angle contained between the connection section 13 and the locating section 40 (or the reverse bent section 14).

Figure 6:
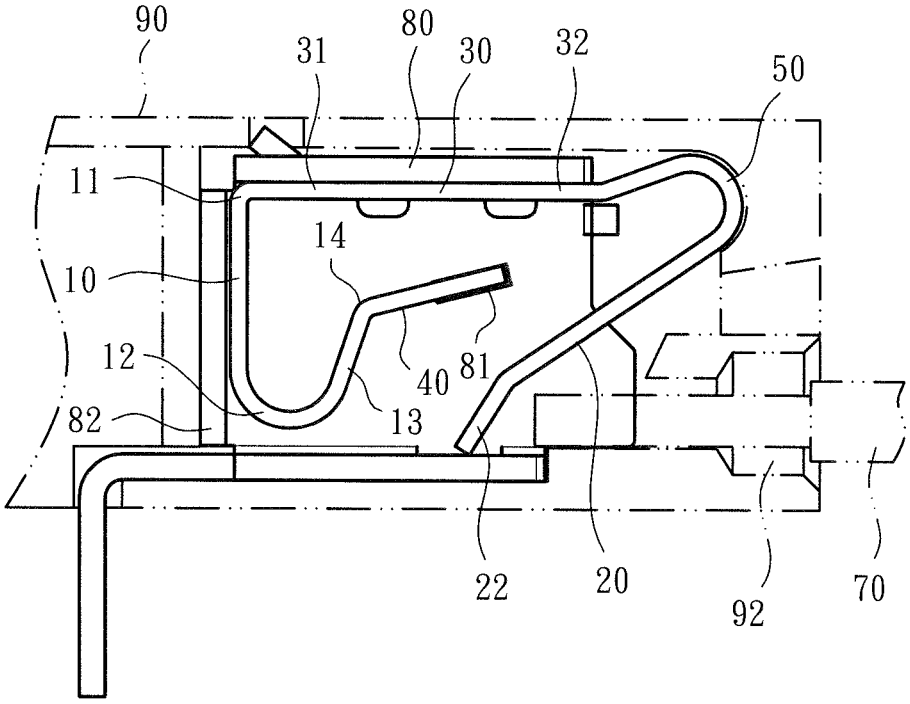
FIG. 6 is a view of a preferred embodiment of the present invention, showing the structure of the subsidiary bent section between the first section and the locating section.

Please refer to FIG. 6, which shows the structure of the subsidiary bent section 12 between the first section 10 and the locating section 40. The subsidiary bent section 12 is formed with an arched structure as the connection section 13. The connection section 13 obliquely extends in a direction to the base section 30 and the second end 32 to form the reverse bent section 14 connected with the locating section 40.

It should be noted that the structural form of the first section 10, the subsidiary bent section 12 and the connection section 13 as shown in FIGS. 5 and 6 increases the length of the first section 10. Correspondingly, the attachment length or area of the first section 10 to the sidewall 82 of the electrical connection member is increased so that the electrical connection member 80 can provide greater support effect for the main body 100 and the main body 100 and the electrical connection member 80 can be more securely assembled with each other.

Figure 7:
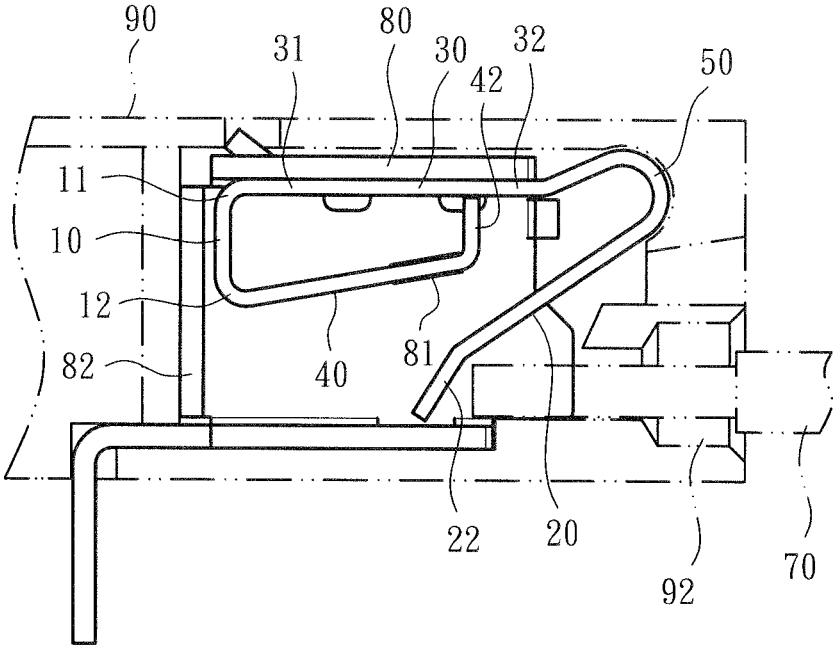
FIG. 7 is a view of a modified embodiment of the present invention, showing the structure of the locating section bent to form the locating portion.

Please now refer to FIG. 7, which shows a modified embodiment of the main body 100 of the present invention. In this embodiment, the tail section 42 of the locating section 40 of the main body is bent toward the base section 30 into contact with the base section 30 to form a locating portion structure and set up an auxiliary locating support point to enhance the effect that the locating section 40 prevents the second section 20 from being over-biased and the securing system of the assembly of the protrusion section 41 and the recess 81.

Figure 8:
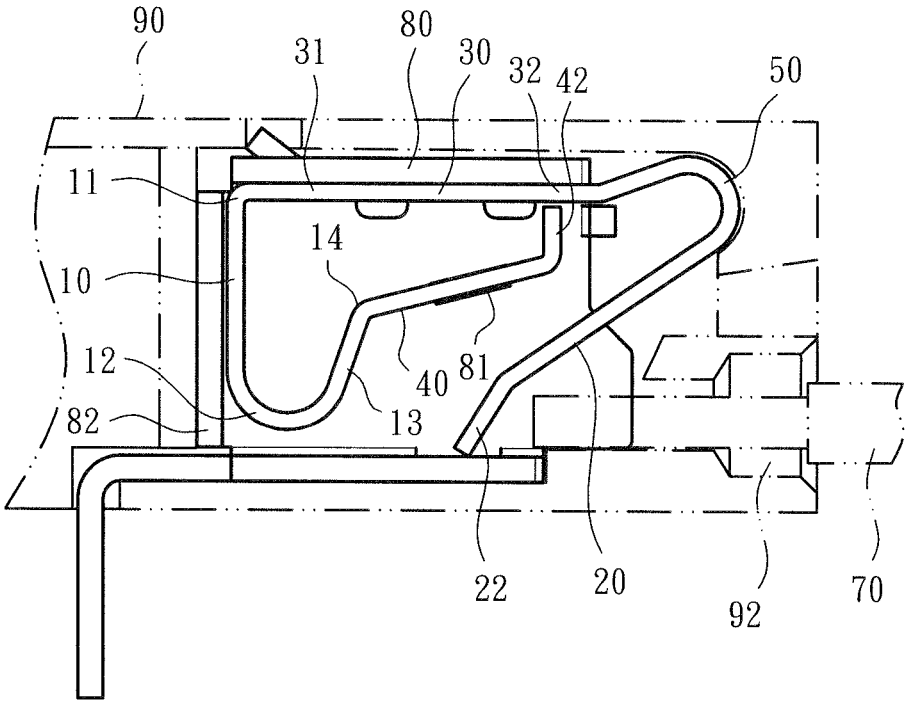
FIG. 8 is a view of a modified embodiment of the present invention, showing the structures of the subsidiary bent section between the first section and the locating section and the locating section bent to form the locating portion.

FIG. 8 shows the structures of the subsidiary bent section 12 between the first section 10 and the locating section 40 of the main body and the head section 41 and the locating portion formed on the locating section 40. As shown in the drawing, the subsidiary bent section 12 is formed with an arched structure as the connection section 13. The connection section 13 obliquely extends in a direction to the base section 30 and the second end 32 to form the reverse bent section 14 connected with the locating section 40.

Figure 9:
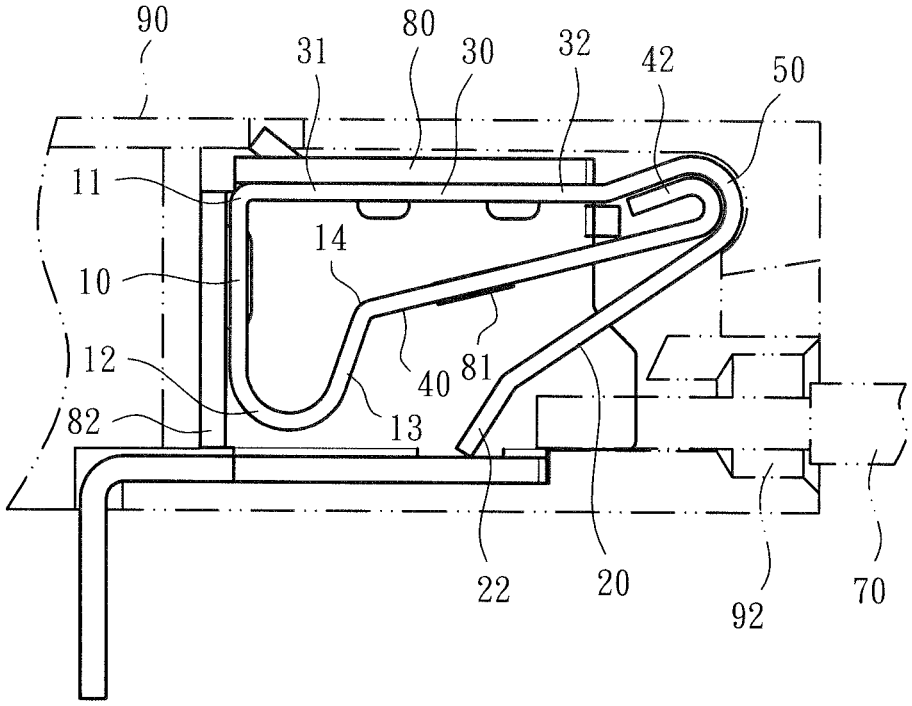
FIG. 9 is a view of a modified embodiment of the present invention, showing the structures of the subsidiary bent section between the first section and the locating section and the locating section extending to the bight section.

FIG. 9 is a view of a modified embodiment of the main body 100, showing the structures of the subsidiary bent section 12 between the first section 10 and the locating section 40 and the locating section 40 extending to the bight section 50. As shown in the drawing, the subsidiary bent section 12 is formed with an arched structure as the connection section 13. The connection section 13 obliquely extends in a direction to the base section 30 and the second end 32 to form the reverse bent section 14 connected with the locating section 40.

FIG. 9 also shows that the tail section 42 of the locating section 40 extends to a position close to the bight section 50 to form a hook structure along the curvature of the bight section 50. Therefore, when the conductive wire 70 pushes the second section 20 to move toward the locating section 40, in case the second section 20 reaches or contacts the tail section 42, the hook structure of the tail section 42 will prevent the second section 20 from being over-biased. Also, the tail section 42 will provide an elastic action force to push/press the second section 20 to increase the pressing force of the second section 20 against the conductive wire 70.

Figure 10:
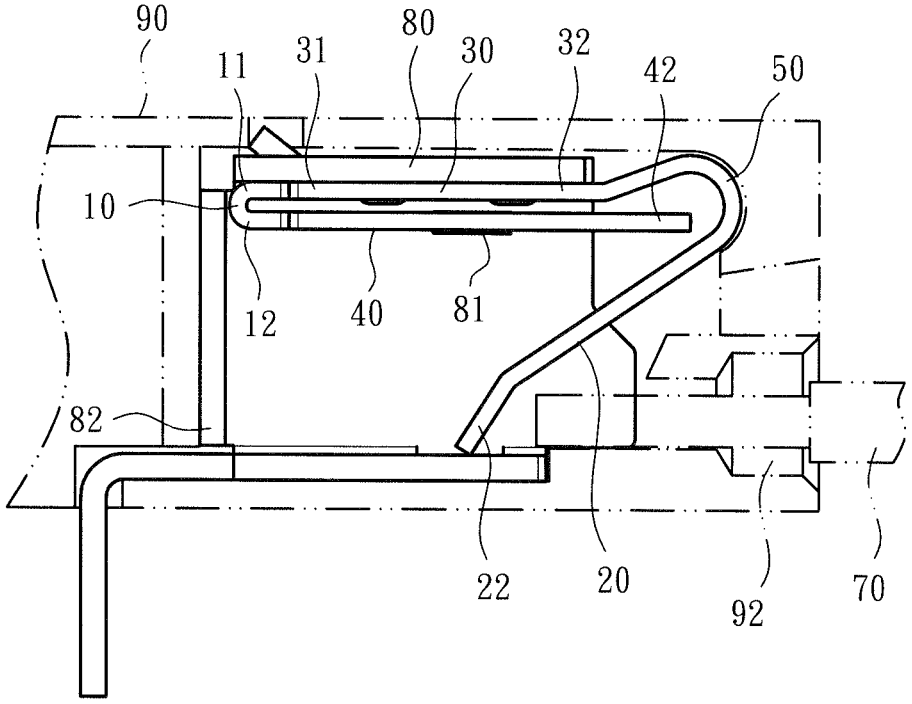
FIG. 10 is a view of a preferred embodiment of the present invention, showing the structure of the locating section extending to the bight section.

Please now refer to FIG. 10, which shows a preferred embodiment of the main body 100 of the present invention. In this embodiment, the length of the first section 10 is as minimized as possible. Also, through the subsidiary bent section 12, the first section 10 is bent toward the second end 32 of the base section and extends to form the locating section 40. In addition, the locating section 40 is parallel to the base section 30.

Also, as shown in the drawing, the tail section 42 of the locating section 40 extends to a position close to the bight section 50.

To speak representatively, in condition of optimal and stable operation, in comparison with the conventional electrical connection terminal, the metal leaf spring structure of electrical connection terminal of the present invention has the following advantages:

1. The main body 100 and the electrical connection terminal device or the relevant connection components thereof have been redesigned in use, structure and connection relationship. For example, the bent section 11 is formed between the base section 30 and the first section 10 of the main body and the subsidiary bent section 12 is formed between the first section 10 and the locating section 40. A protrusion section 41 is formed on the locating section 40 and assembled in the recess 81 of the electrical connection member 80. The tail section 42 of the locating section 40 is bent toward the base section 30 to form the locating portion or extends to the bight section 50 to form the hook structure along the curvature of the bight section 50. The structure of the present invention is obviously different from the conventional electrical connection terminal. Also, the present invention changes the use form of the conventional electrical connection terminal.
2. In the structural form of the main body 100 and/or the electrical connection member 80, the structure of the cooperative protrusion section additionally formed on the reception member (or frame body) of the conventional electrical connection terminal is removed. Accordingly, the present invention improves the shortcoming of the conventional electrical connection terminal that the cooperative structure is relatively complicated and the clamping leg (or the free end of the metal leaf spring) is apt to deflect and pass over the protrusion section to deteriorate the effect that the protrusion section prevents the clamping leg from being over-biased.
3. In the condition that the metal leaf spring can keep stably pressing and restricting the conductive wire, a true moving range of the main body 100 (or the second section 20 thereof) is set up. Especially, the locating section 40 of the main body 100 itself forms a preset end position, which is formed by means of directly pressing the main body 100. In contrast, in the conventional electrical connection terminal, it is necessary to additionally dispose a cooperative component or stop component. The present invention obviously can lower the manufacturing cost. Furthermore, the second section 20 can only move to reach the set end position, where the main body 100 and/or the locating section 40 can stop the second section 20. Therefore, no matter how the second section 20 moves (or deflects), the free end of the second section 20 cannot pass over the main body 100 so that the free end is prevented from being over-biased. In this case, the possibility that the metal leaf spring is over-bent to shorten the lifetime of the electrical connection terminal as in the conventional structure is minimized.

In conclusion, the metal leaf spring structure of electrical connection terminal of the present invention is different from the conventional electrical connection terminal in space form and is advantageous over the conventional electrical connection terminal. The metal leaf spring structure of electrical connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. A metal leaf spring structure of electrical connection terminal, comprising a main body, the main body having a base section defined with a first end and a second end, the first end being connected with a first section and a locating section, the second end being connected with a bight section and a reciprocally movable second section, a bent section being formed between the first end of the base section and the first section, the bent section containing an angle, the first section being bent toward the second end of the base section and extending to connect with the locating section, wherein a subsidiary bent section is formed between the first section and the locating section, the subsidiary bent section containing an angle, the bight section between the second end of the base section and the second section containing an angle, wherein the second section obliquely extends in a direction to the first end of the base section, the locating section being positioned in a reciprocally moving path of the second section, the locating section thereby extending between the base and second sections to define a moving end point for stopping deflection of the second section towards the base section responsive to insertion of a conductive wire into the metal leaf spring structure.

2. The metal leaf spring structure of electrical connection terminal as claimed in claim 1, wherein a protrusion section is formed on a lateral side of the locating section, the protrusion section being fixable in a recess formed on a case or an electrical connection member.

3. The metal leaf spring structure of electrical connection terminal as claimed in claim 2, wherein a lateral side of the base section is formed with finger sections and the electrical connection member is formed with mouth sections, the finger sections being inserted in the mouth sections to securely assemble the main body with the electrical connection member, the first section being attached to a sidewall of the electrical connection member.

4. The metal leaf spring structure of electrical connection terminal as claimed in claim 1, wherein the angle contained by the bent section is selected from a group consisting of an acute angle, a right angle and an obtuse angle and the angle contained by the subsidiary bent section is selected from a group consisting of an acute angle, a right angle and an obtuse angle.

5. The metal leaf spring structure of electrical connection terminal as claimed in claim 2, wherein the angle contained by the bent section is selected from a group consisting of an acute angle, a right angle and an obtuse angle and the angle contained by the subsidiary bent section is selected from a group consisting of an acute angle, a right angle and an obtuse angle.

6. The metal leaf spring structure of electrical connection terminal as claimed in claim 3, wherein the angle contained by the bent section is selected from a group consisting of an acute angle, a right angle and an obtuse angle and the angle contained by the subsidiary bent section is selected from a group consisting of an acute angle, a right angle and an obtuse angle.

7. The metal leaf spring structure of electrical connection terminal as claimed in claim 1, wherein the locating section of the main body has the form of a plane structure, the locating section having a tail section, the tail section extending to a position of the bight section to provide an elastic action force.

8. The metal leaf spring structure of electrical connection terminal as claimed in claim 2, wherein the locating section of the main body has the form of a plane structure, the locating section having a tail section, the tail section extending to a position of the bight section to provide an elastic action force.

9. The metal leaf spring structure of electrical connection terminal as claimed in claim 3, wherein the locating section of the main body has the form of a plane structure, the locating section having a tail section, the tail section extending to a position of the bight section to provide an elastic action force.

10. The metal leaf spring structure of electrical connection terminal as claimed in claim 4, wherein the locating section of the main body has the form of a plane structure, the locating section having a tail section, the tail section extending to a position of the bight section to provide an elastic action force.

11. The metal leaf spring structure of electrical connection terminal as claimed in claim 5, wherein the locating section of the main body has the form of a plane structure, the locating section having a tail section, the tail section extending to a position of the bight section to provide an elastic action force.

12. The metal leaf spring structure of electrical connection terminal as claimed in claim 6, wherein the locating section of the main body has the form of a plane structure, the locating section having a tail section, the tail section extending to a position of the bight section to provide an elastic action force.

13. The metal leaf spring structure of electrical connection terminal as claimed in claim 1, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

14. The metal leaf spring structure of electrical connection terminal as claimed in claim 2, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

15. The metal leaf spring structure of electrical connection terminal as claimed in claim 3, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

16. The metal leaf spring structure of electrical connection terminal as claimed in claim 4, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

17. The metal leaf spring structure of electrical connection terminal as claimed in claim 5, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

18. The metal leaf spring structure of electrical connection terminal as claimed in claim 6, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

19. The metal leaf spring structure of electrical connection terminal as claimed in claim 7, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

20. The metal leaf spring structure of electrical connection terminal as claimed in claim 8, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

21. The metal leaf spring structure of electrical connection terminal as claimed in claim 9, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

22. The metal leaf spring structure of electrical connection terminal as claimed in claim 10, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

23. The metal leaf spring structure of electrical connection terminal as claimed in claim 11, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

24. The metal leaf spring structure of electrical connection terminal as claimed in claim 12, wherein a connection section is disposed between the subsidiary bent section and the locating section of the main body, the connection section obliquely extending in a direction to the base section and the second end to form a reverse bent section connected with the locating section, an angle contained between the first section and the connection section being an acute angle smaller than an obtuse angle contained by the reverse bent section between the connection section and the locating section.

25. The metal leaf spring structure of electrical connection terminal as claimed in claim 1, wherein the subsidiary bent section is formed with an arched structure.

26. The metal leaf spring structure of electrical connection terminal as claimed in claim 2, wherein the subsidiary bent section is formed with an arched structure.

27. The metal leaf spring structure of electrical connection terminal as claimed in claim 3, wherein the subsidiary bent section is formed with an arched structure.

28. The metal leaf spring structure of electrical connection terminal as claimed in claim 1, wherein the locating section of the main body has a tail section, the tail section being bent toward the base section into contact with the base section.

29. The metal leaf spring structure of electrical connection terminal as claimed in claim 2, wherein the locating section of the main body has a tail section, the tail section being bent toward the base section into contact with the base section.

30. The metal leaf spring structure of electrical connection terminal as claimed in claim 3, wherein the locating section of the main body has a tail section, the tail section being bent toward the base section into contact with the base section.

31. The metal leaf spring structure of electrical connection terminal as claimed in claim 2, wherein the locating section of the main body has a tail section, the tail section extending to a position of the bight section to form a hook structure along the curvature of the bight section, and wherein the tail section can thereby provide an elastic action force.

32. The metal leaf spring structure of electrical connection terminal as claimed in claim 3, wherein the locating section of the main body has a tail section, the tail section extending to a position of the bight section to form a hook structure along the curvature of the bight section, and wherein the tail section can thereby provide an elastic action force.

33. The metal leaf spring structure of electrical connection terminal as claimed in claim 2, wherein through the subsidiary bent section, the first section of the main body is bent toward the second end of the base section and extends to form the locating section, the locating section being parallel to the base section, the locating section having a tail section extending to a position of the bight section.

34. The metal leaf spring structure of electrical connection terminal as claimed in claim 3, wherein through the subsidiary bent section, the first section of the main body is bent toward the second end of the base section and extends to form the locating section, the locating section being parallel to the base section, the locating section having a tail section extending to a position of the bight section.

35. A metal leaf spring structure of electrical connection terminal, comprising a main body, the main body having a base section defined with a first end and a second end, the first end being connected with a first section and a locating section, the second end being connected with a bight section and a reciprocally movable second section, a bent section being formed between the first end of the base section and the first section, the bent section containing an angle, the first section being bent toward the second end of the base section and extending to connect with the locating section, wherein a subsidiary bent section is formed between the first section and the locating section, the subsidiary bent section containing an angle, the bight section between the second end of the base section and the second section containing an angle, wherein the second section obliquely extends in a direction to the first end of the base section, the locating section being positioned in a reciprocally moving path of the second section to define a moving end point of the second section, wherein the locating section of the main body has a tail section, the tail section extending to a position of the bight section to form a hook structure along the curvature of the bight section, and wherein the tail section can thereby provide an elastic action force.

36. A metal leaf spring structure of electrical connection terminal, comprising a main body, the main body having a base section defined with a first end and a second end, the first end being connected with a first section and a locating section, the second end being connected with a bight section and a reciprocally movable second section, a bent section being formed between the first end of the base section and the first section, the bent section containing an angle, the first section being bent toward the second end of the base section and extending to connect with the locating section, wherein a subsidiary bent section is formed between the first section and the locating section, the subsidiary bent section containing an angle, the bight section between the second end of the base section and the second section containing an angle, wherein the second section obliquely extends in a direction to the first end of the base section, the locating section being positioned in a reciprocally moving path of the second section to define a moving end point of the second section, wherein through the subsidiary bent section, the first section of the main body is bent toward the second end of the base section and extends to form the locating section, the locating section being parallel to the base section, the locating section having a tail section extending to a position of the bight section.

* * * * *